United States Patent [19]

Chung-Cheng

[11] Patent Number: 5,007,572

[45] Date of Patent: Apr. 16, 1991

[54] ELECTRICAL STAPLER

[76] Inventor: Lin Chung-Cheng, 2FL., No. 7-2, Lane 27, Chungshan N. Rd., Sec. 2, Taipei, Taiwan

[21] Appl. No.: 572,425

[22] Filed: Aug. 27, 1990

[51] Int. Cl.[5] ..... B25C 5/02; B25C 7/00; B27F 7/79; B27F 7/36

[52] U.S. Cl. ..... 227/7; 227/131

[58] Field of Search ..... 227/7, 131

[56] References Cited

U.S. PATENT DOCUMENTS

| | | | |
|---|---|---|---|
| 4,542,844 | 9/1985 | Olesen et al. | 227/7 |
| 4,589,581 | 5/1986 | Balma | 227/7 |
| 4,726,505 | 2/1988 | Okazaki | 227/131 X |

*Primary Examiner*—Paul A. Bell

*Attorney, Agent, or Firm*—Asian Pacific International Patent & Trademark Office

[57] ABSTRACT

An electrical stapler wherein when papers to be stapled are inserted into a stapling groove, a fine switch is touched to activate a motor for driving a gear set, the gear set being provided with two biasing rods which can bias a Y-shaped linkage of a stapling mechanism, a fixing rod being pivotably connected with front end of the Y-shaped linkage, two ends of the fixing rod being respectively connected to two springs, a pressing plate being disposed on the fixing rod whereby when operated, the pressing plate is bounded by the springs to strike out a staple from a staple magazine, a controlling circuit being used to control the stapling operation for saving labor and enhancing working efficiency.

1 Claim, 6 Drawing Sheets

ELECTRICAL STAPLER

BACKGROUND OF THE INVENTION

The present invention relates to a novel electrical stapler, wherein an auto-controlling circuit is applied to activate a motor to drive a gear set and a Y-shaped linkage so as to further urge a pressing plate to move vertically for completing auto-stapling movement.

A stapler has become an inevitable stationery in modern life, especially in respect of students and clerks. Currently, only stapler with smaller size is developed, while the structure of common stapler is not greatly changed and only manually operated stapler is available on the market. Such stapler can only be applied at a slow stapling speed and the thickness of papers to be stapled is limited, and therefore, a user often staples a document or the like on its both faces to keep all papers together. As a result, the appearance of the stapled document will be poor. In conclusion, using the manually operated stapler is a labor-wasting and time-wasting task and only low working efficiency can be achieved.

It is therefore tried by the applicant to develop an electrical stapler to eliminate the aforesaid drawbacks existing in prior art.

SUMMARY OF THE INVENTION

It is a primary object of this invention to provide a novel electrical stapler in which an auto-controlling circuit is used to activate a motor which drives a gear set having biasing rods capable of pressing a Y-shaped linkage to urge a pressing plate to move vertically to perform auto-stapling function.

It is a further object of this invention to provide the above electrical stapler, wherein the biasing rods of the gear set is capable of controlling the opening and closing of the limit switch, keeping the circuit of the stapler in closing state when operating the stapler.

It is still a further object of this invention to provide the above electrical stapler wherein the auto-controlling circuit is composed of the limit switch and a fine switch whereby when the papers to be stapled touch the fine switch, the stapling movement is automatically performed once to thus save the labor and simplify the stapling operation.

The present invention can be best understood through the following description and accompanying drawings wherein:

DETAILED DESCRIPTION OF THE PREFERRED EMBODIMENTS

Figure 1:
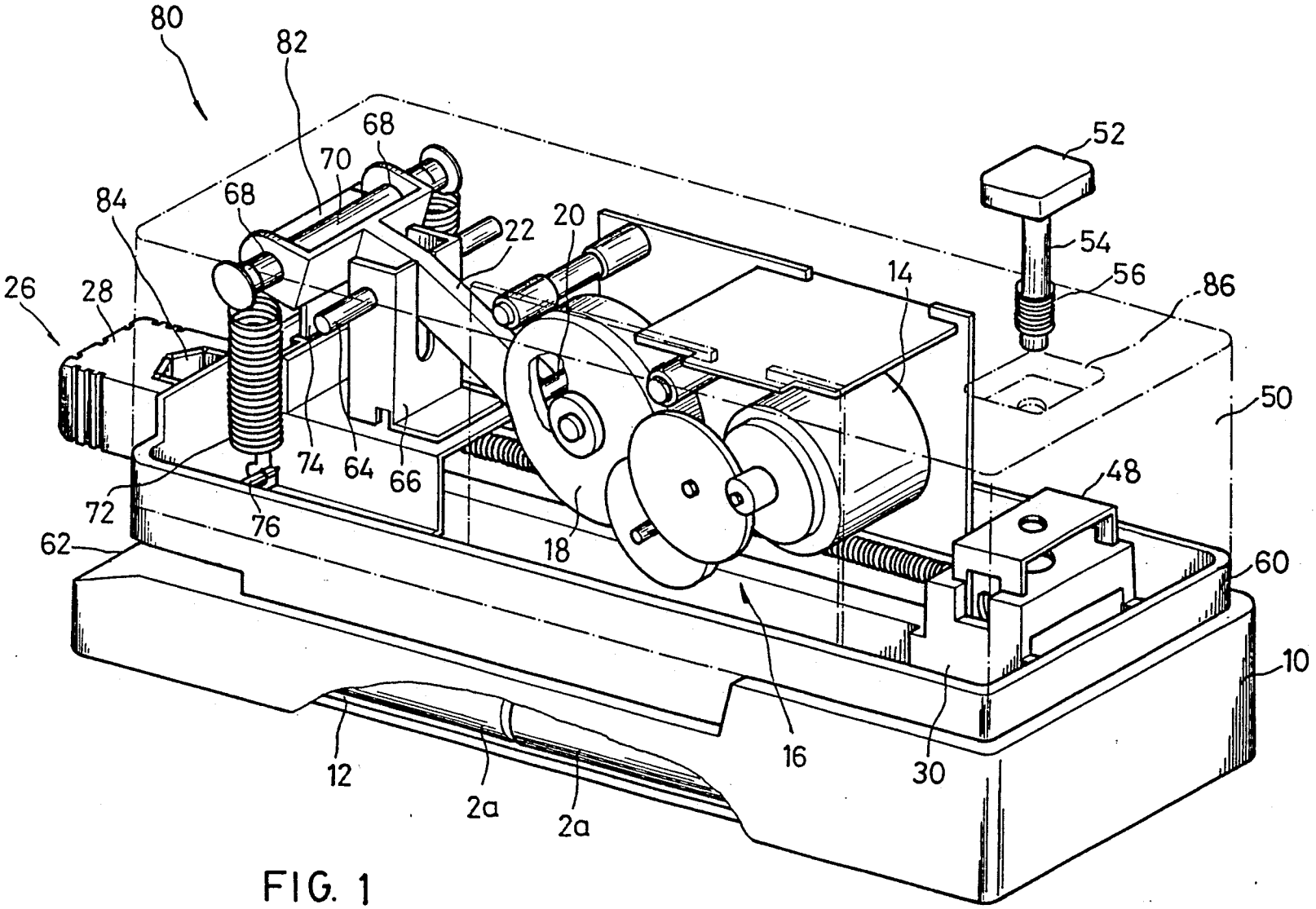
FIG. 1 is a perspective view of the invention.
Figure 2:
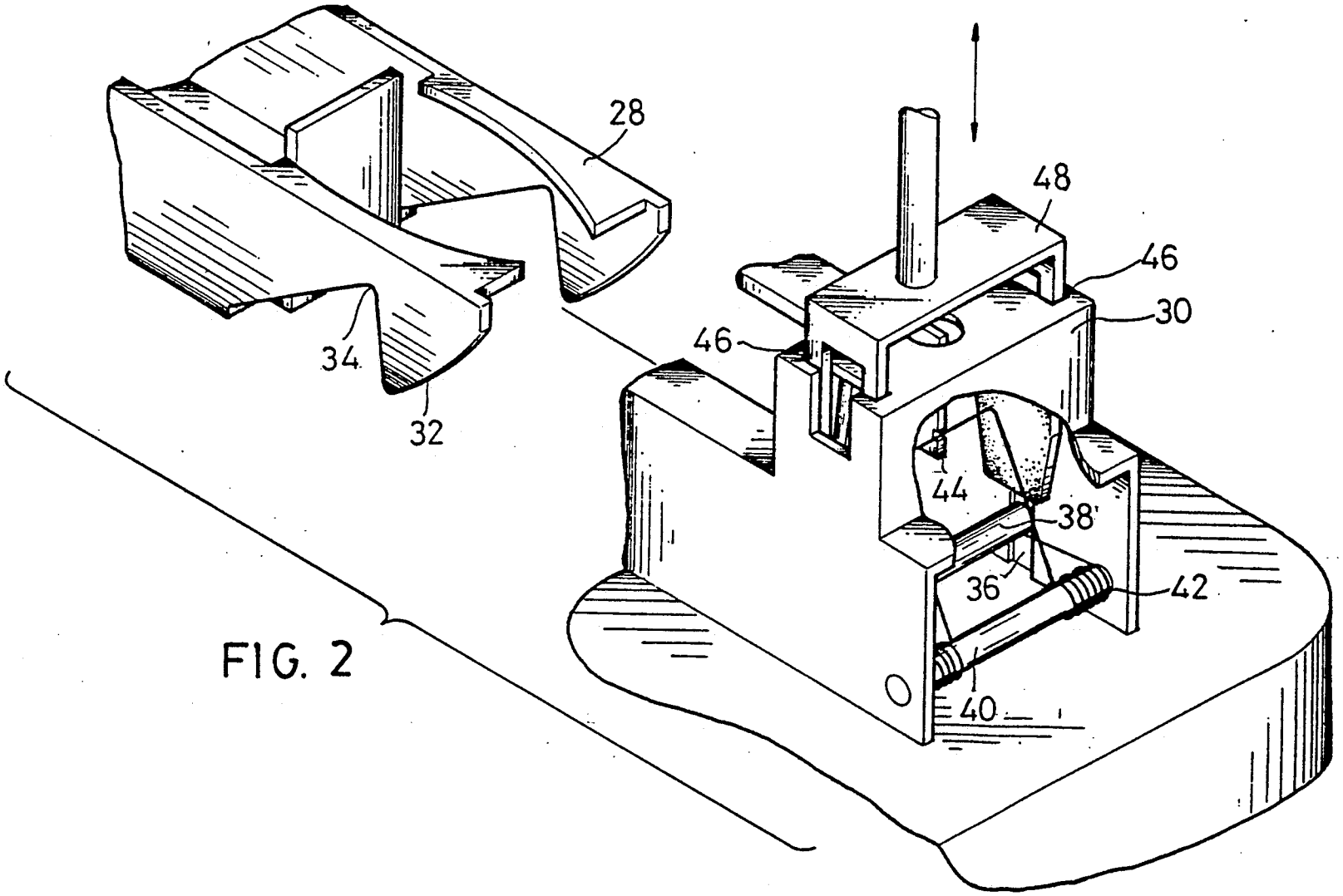
FIG. 2 is a partially enlarged view of the staple magazine of this invention.
Figure 3:
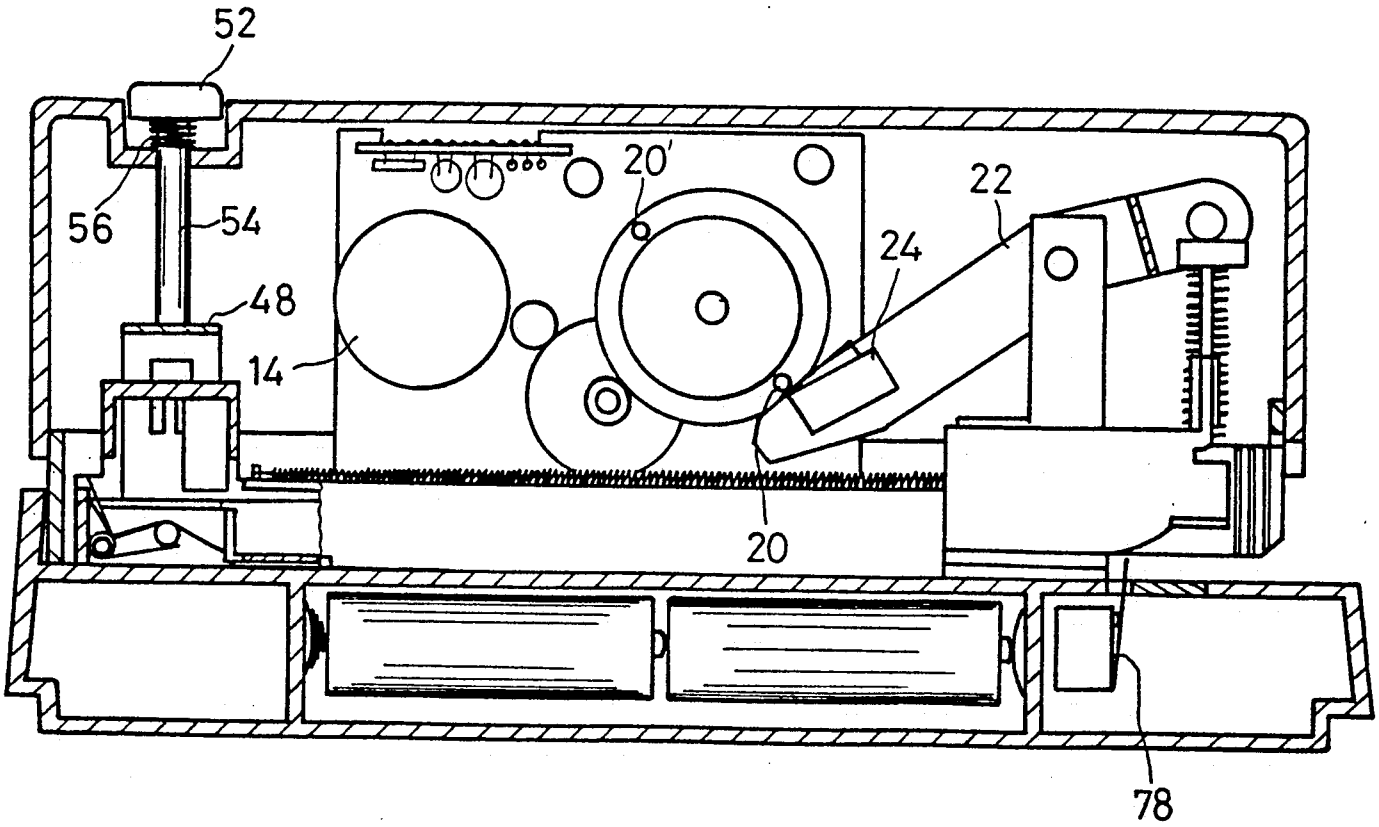
FIG. 3 shows the first stapling state of this invention.
Figure 5:
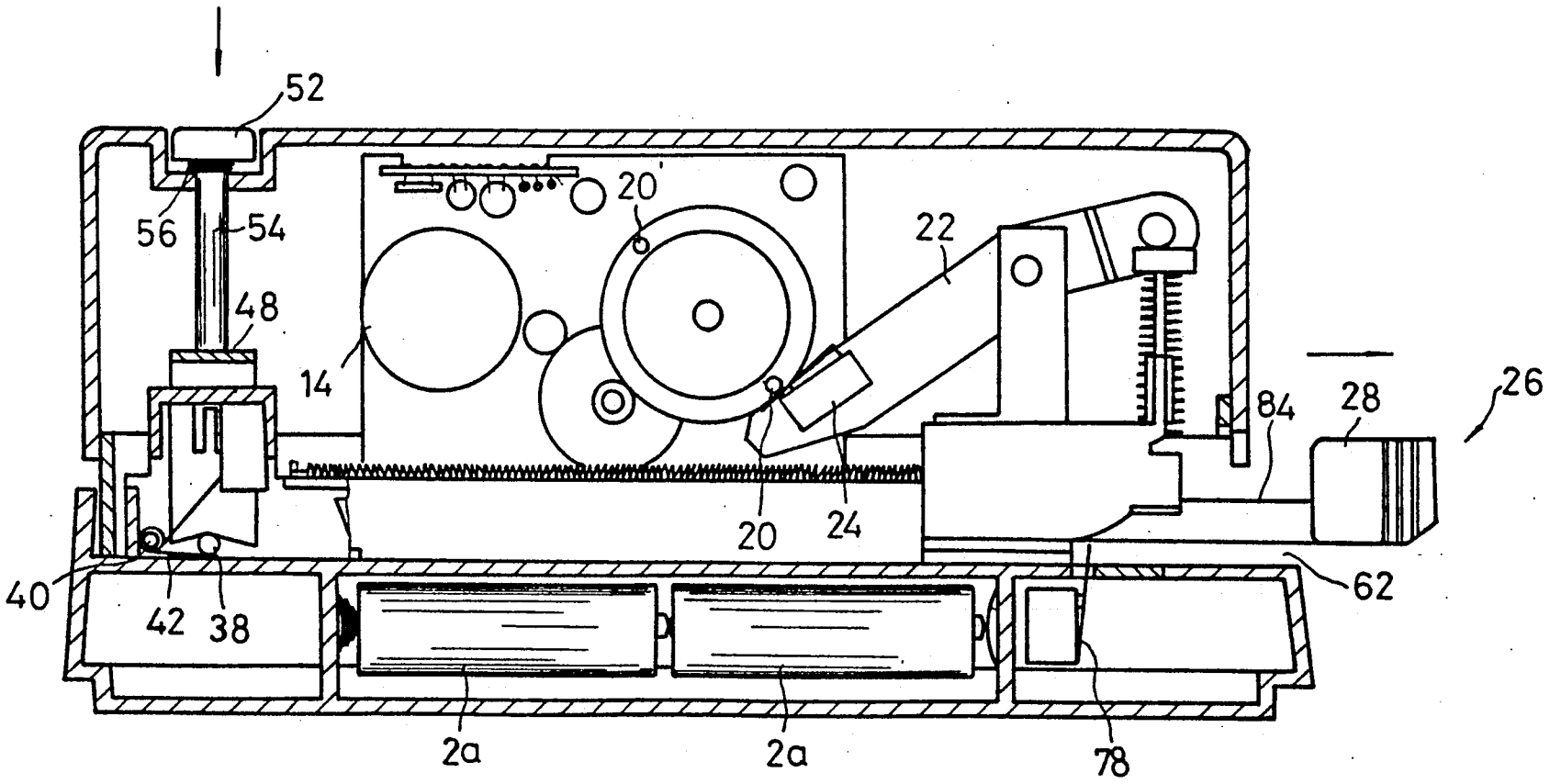
FIG. 5 shows that the button is pressed down, making the staple magazine extend forward.

Please first refer to FIG. 1. The present invention includes a base 10 provided with a battery container 12 for receiving batteries 2*a* serving as power source. The battery container 12 is electrically connected to a motor 14 by wires whereby the motor 14 can drive a gear set 16. A last driven gear disk 18 of the gear set 16 is equipped with two biasing rods 20, 20′ on its periphery at proper positions. Referring now to FIGS. 2 and 3. When the motor 14 operates, the biasing rods 20, 20′ is driven to press down one end of a Y-shaped linkage 22 so as to control the opening and closing of a limit switch 24. A staple magazine 26 is disposed above front end of the base 10. The staple magazine 26 is composed of a magazine portion 28 and a slide channel 30. The magazine portion 28 is formed with an arch hook portion 32. In addition, on vertical walls of rear end of the slide channel 30 are formed two opposite slide groves 36. A transverse movable rod 38 is slidably disposed between the two slide grooves 36. A fixing rod 40 is disposed behind the movable rod 38 at rear end of the slide channel 30. A restoring spring 42 is fitted on the fixing rod 40 with its one end extending into the base of the movable rod 38 and its other end engaging with an intermediate plate 44 whereby the movable rod 38 can be restored by the restoring spring 42. On upper surface of rear end of the slide channel 30 are formed through holes 46 into which a⊓-shaped plate 48 is placed to abut against the movable rod 38. Please refer to FIG. 5, when pressing down a button 52 located in a hole 86 of an upper cover 50, the⊓-shaped plate 48 is consequently pressed down to downward move the movable rod 38 away from the engaging recess 34 of the magazine portion 28, permitting the magazine portion 28 to bound forward. A compressing spring 56 is fitted on a shaft rod 54 connected with the button 52 thereunder to that the button 52 can be restored to its original position after being pressed. At this time, one can place a new set of staples into the magazine portion 28. Reversely, the magazine portion 28 can be pushed backward, making the engaging recess 34 engage with the movable rod 38. A wall plate 60 is fixed on the base 10 to form a stapling channel 62.

Figure 4:
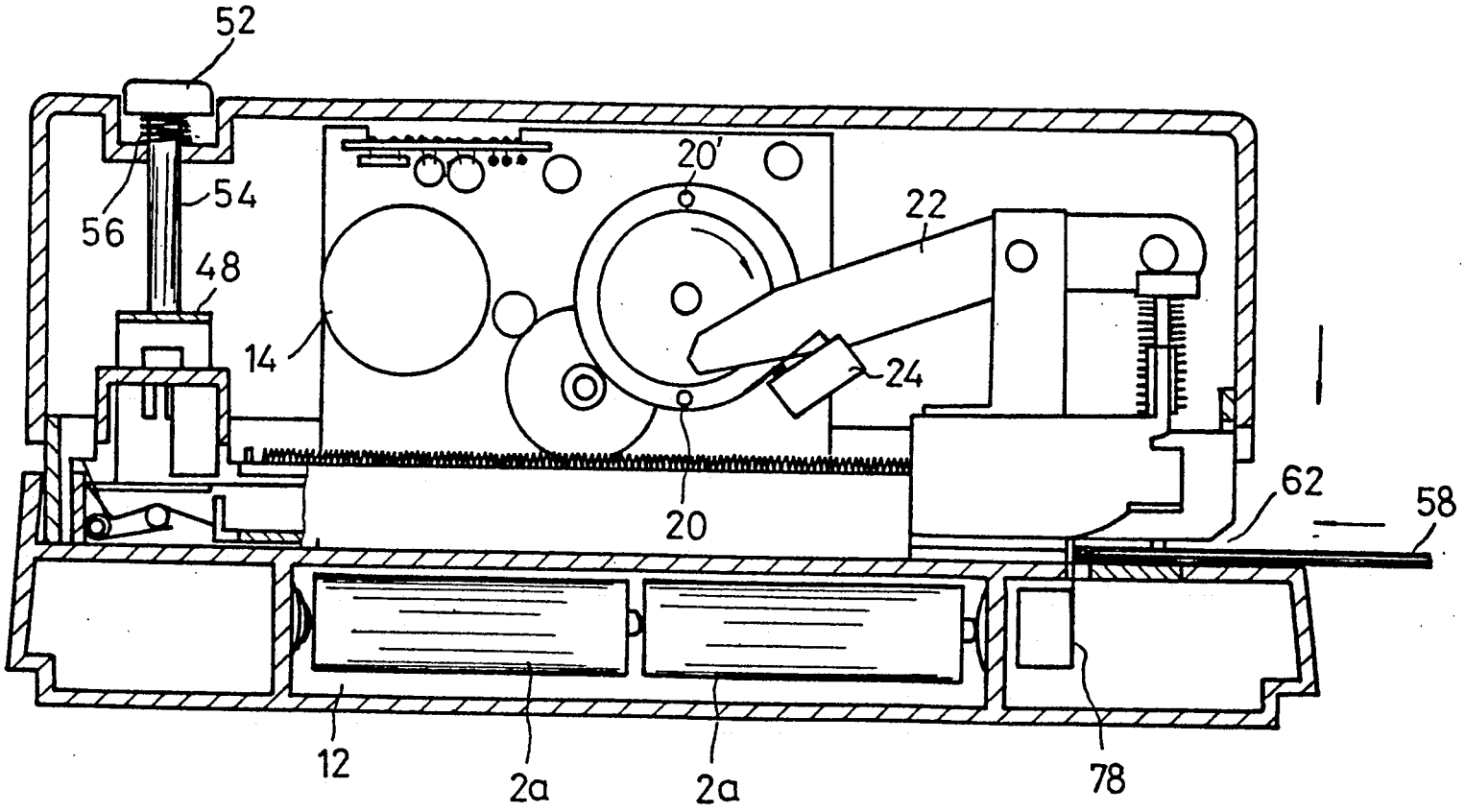
FIG. 4 shows the second stapling state thereof according to FIG. 3.
Figure 6:
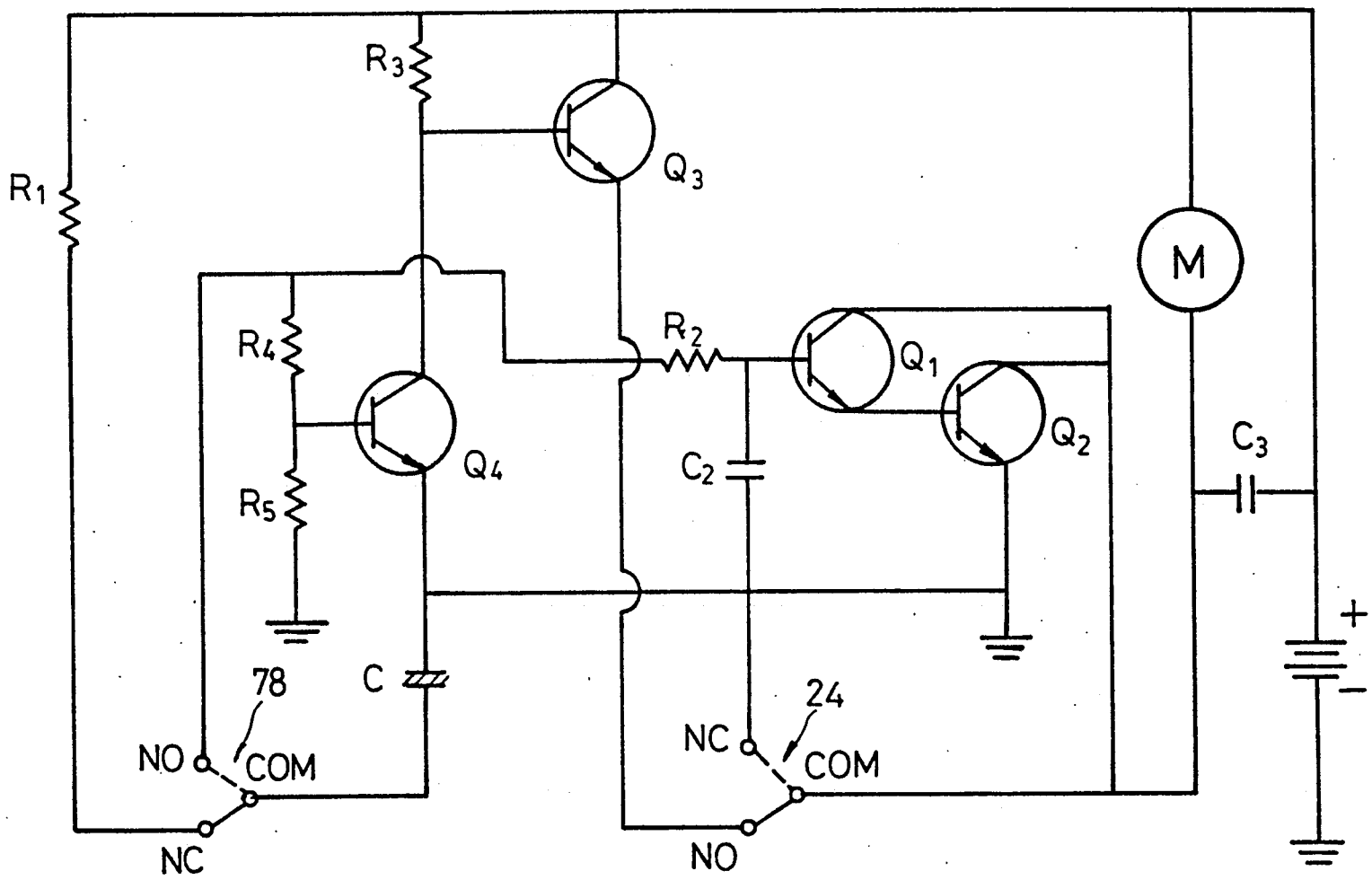
FIG. 6 is a circuit diagram of this invention.

As shown in FIGS. 3 and 4, when in a not used state, the biasing rod 20 of the gear disk 18 abuts against the limit switch 24 and Y-shaped linkage 22, making the limit switch 24 switched off. At this time, the motor 14 is in a stop state. When papers or documents are placed into the stapling channel 62, a fine switch 78 is touched and activated, making the motor 14 drive the gear set 16 which further drives the gear disk 18 through a transmission mechanism. Consequently, the biasing rods 20, 20′ of the gear disk 18 rotate along with the gear disk 18, and the biasing rod 20 separates from the limit switch 24 and Y-shaped linkage 22. The Y-shaped linkage 22 is pivoted to the fixing plate 66 by a shaft 64 at a proper position. Front end of the Y-shaped linkage 22 is formed with through holes 68 through which a fixing rod 70 is disposed. Two ends of the fixing rods 70 are connected with two compressing springs 72 which further connect with a fixing member 76 whereby when not forced, the biasing rod 20 will be restored by the compressing spring 72, making the pressing plate 74 located under the fixing rod 70 move downward to strike a staple out of the magazine portion. When the Y-shaped linkage 22 leaves the limit switch 24, the circuit is closed to make the motor 14 continuously operate. The related circuit is shown in FIG. 6. Subsequently, following the continuous rotation of the gear disk 18, the biasing rod 20 of the gear disk 18 urges the Y-shaped linkage 22, making one end of the Y-shaped linkage 22 again abut against the limit switch 24 to switch off the fine switch 78. At this time, the stapling movement is completed, and next activation of the fine switch 78 will start next stapling movement.

Please refer to FIG. 6 which shows the circuit diagram of this invention. When in not used state, contact point COM of the limit switch 24 is disconnected from contact point NC and connected with contact point NO, and contact point COM of the fine switch 78 is disconnected from contact point NO and connected with contact point NC, whereby the capacitor C1 of the fine switch 78 is charged by power source through resistor R1. When a document 58 is placed into the stapling channel 62, the fine switch 78 will be pushed, making the contact point COM thereof disconnected from contact point NC and connected with contact point NO whereby the capacitor C1 will discharge and through resistor R2 supply bias voltage for base of transistors Q1 and Q2 of Darlington circuit which then works and drive the motor 14. Capacitor C2 is for stabilizing the working of Darlington circuit, and capacitor C3 is for filtering the noise. By means of discharging of capacitor C1, through resistors R4, R5, the base of transistor Q4 is supplied with a divided voltage so as to work and interrupt the bias voltage supplied by resistor R3 to transistor Q3. When the motor 14 operates, the bias rod 20 leaves the limit switch 24, making the contact point COM thereof disconnected from contact point NO and connected with contact point NC so that the power for the motor 14 to operate is alternatively supplied by the limit switch. After the discharging of capacitor C1 is completed, the power for transistors Q1,Q2 and Q4 is cut off and when transistor Q4 does not work, the transistor Q3 is supplied with bias voltage by resistor R3 to work. When the motor 14 drives the gear disk 18 to rotate, making the biasing rod thereof abut against the limit switch 24, the contact point COM of limit switch 24 is disconnected from contact point NO and connected with contact point NO so as to stop the motor 14, and the transistor Q3 will work to produce positive voltage which is sent to negative electrode of the motor through limit switch 24, making the inner magnetic field of the motor change instantly to achieve braking effect so that the location of biasing rod 20 will not be biased by the inertia of the motor 14. Therefore, the stapler will restore to a stationary state after each stapling movement and wait for the next stapling movement.

It will also be understood that which I have described a presently preferred embodiment of my invention in full detail, it will be obvious that my invention is not to be limited thereto or thereby, but only by that of the appended claims.

What is claimed is:

1. An electrical stapler comprising:

a base provided with a battery container;

a motor serving as a driving means;

a stapling mechanism wherein a Y-shaped linkage is pivoted to a fixing plate, and front end of said Y-shaped linkage is formed with a through hole, a fixing rod being inserted into said through hole, two ends of said fixing rod being respectively connected with two compression springs, other ends of said springs being mounted on a fixing member;

a gear set having several gears one of which meshes with said motor and another of which is a driven gear disk, on one side of said driven gear being disposed symmetrical biasing rods which can press one end of said Y-shaped linkage when operated;

a fine switch suitable to be pressed by said biasing rods to control opening/closing of a circuit;

a middle board fixed on said base to form a stapling groove therebetween;

a magazine portion having a staple groove rear end of which is disposed an arch hook and an engaging recess;

a slide groove a rear vertical wall of which is formed with two opposite slide channels, a transverse movable rod being disposed in and between said slide channels, a fixing rod being disposed at rear end of said slide groove, a pressing plate being disposed under said fixing rod, a buffer pad being disposed between said pressing board and fixing rod, a restoring spring being fitted on said fixing rod, one end of said restoring spring being extended to lower portion of said movable rod, the other end of said restoring spring being engaged with said middle board so that said movable rod can be restored to its original position, a through hole being formed on upper surface of rear end of said slide groove;

a magazine means formed by said magazine portion and slide groove;

a ⊓-shaped plate going through said through hole of said slide groove to abut against said movable rod;

an upper cover covering said base and having a hole corresponding to said ⊓-shaped plate;

a pressing button having a lower shaft rod, a spring being fitted on said shaft rod, lower end of said shaft rod being extended through said hole of said upper cover to abut against said ⊓-shaped plate; and a limit switch disposed in said base and slightly protruding beyond said stapling groove; whereby when said limit switch is touched and activated by papers to be stapled, said motor will drive said gear set so as to rotate said gear disk, making said biasing rods separated from said Y-shaped linkage so that said pressing plate is no more bound and will be bounded downward by a spring to strike out a staple placed in said stapling groove, and when another biasing rod again abuts against said Y-shaped linkage and touched said fine switch, said motor stops and one stapling movement is completed.

* * * * *